United States Patent [19]

DiSieno

[11] Patent Number: 4,720,104

[45] Date of Patent: Jan. 19, 1988

[54] STICKBALL BAT CONSTRUCTION

[76] Inventor: Martin DiSieno, 28-12 Astoria Blvd., Long Island City, Queens, N.Y. 11102

[21] Appl. No.: 904,954

[22] Filed: Sep. 8, 1986

[51] Int. Cl.[4] ..... A63B 59/06

[52] U.S. Cl. ..... 273/67 R

[58] Field of Search ..... 273/67 R, 72 A, 72 R, 273/84 R

[56] References Cited

U.S. PATENT DOCUMENTS

| | | | |
|---|---|---|---|
| 3,179,412 | 4/1965 | Niederberger | 273/67 R |
| 3,469,839 | 9/1969 | Pietronuto et al. | 273/72 R |
| 3,479,030 | 11/1969 | Merok | 273/72 A |
| 3,955,816 | 5/1976 | Bratt | 273/72 R |
| 4,323,239 | 4/1982 | Ishii | 273/72 A |
| 4,569,521 | 2/1986 | Mueller | 273/72 A |

FOREIGN PATENT DOCUMENTS

| | | | |
|---|---|---|---|
| 962291 | 2/1975 | Canada | 273/72 A |

OTHER PUBLICATIONS

Sporting Goods Dealer, Nov. 1972, p. 33.

*Primary Examiner*—Thomas F. Callaghan
*Attorney, Agent, or Firm*—Natter & Natter

[57] ABSTRACT

A stickball bat construction includes a tubular aluminum barrel provided with a wood handle press-fit within one end of the barrel and an edge protector press-fit within the other end of the barrel. The handle includes a collar at the juncture between the barrel and the handle to provide a smooth transtional surface. The edge protector projects from the barrel to prevent damage during use. The relationship between the length and density of the wood handle, aluminum barrel and edge protector position the center of gravity between the midpoint of the bat and the end of the handle for providing a rapid acceleration swing and maximum impact with the ball.

15 Claims, 4 Drawing Figures

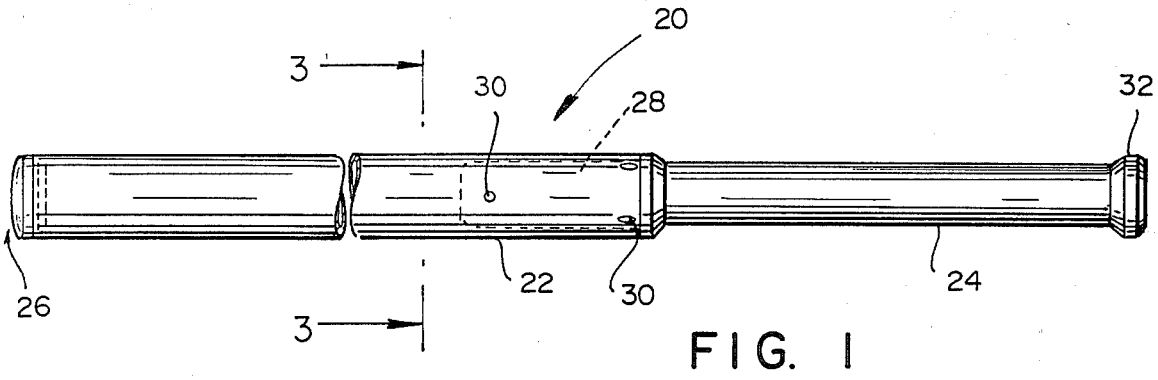
FIG. 1
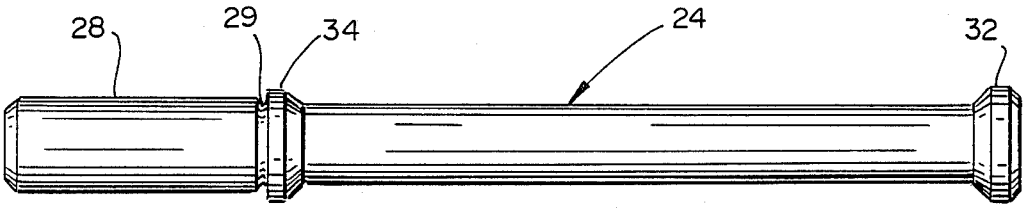
FIG. 2
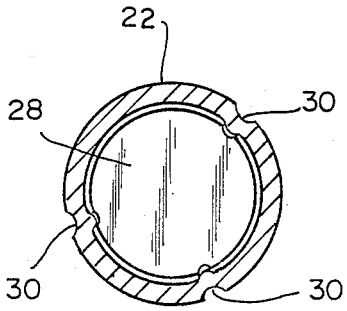
FIG. 3
FIG. 4
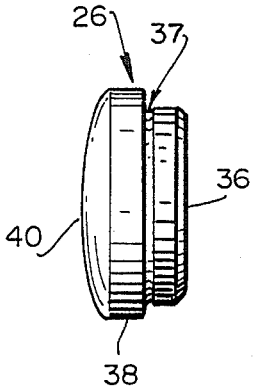

STICKBALL BAT CONSTRUCTION

BACKGROUND OF THE INVENTION

1. Field of the Invention

This invention relates to sports apparatus and especially to a ball-bat construction.

In particular, the device of this invention concerns a stickball bat adapted for striking and propelling a flexible wall, air-filled ball.

2. Description of Related Art

Ball-bats have traditionally been designed with an enlarged diameter head for placing a maximum mass at the point of contact with the ball. Those bats were conventionally tapered toward a handle end to provide a comfortable hand grip. Furthermore, those ball-bats were generally made of wood or more recently of aluminum, and had a weight distribution such that the center of gravity was located at a point greater than one-half the bat length, as measured from the handle end. Those constructions are typically illustrated in U.S. Pat. Nos. 3,479,030 and 3,729,196.

It should be further noted that the ball-bats as previously discussed were intended primarily for use when playing the game of baseball and/or softball.

The ball-bat of the instant invention, however, is concerned with the game of stickball. This sports activity is indigenous to urban areas having limited space for ball fields and is usually played on paved surfaces such as in schoolyards or on city streets. Another aspect of this game is that a hollow core, rubber surface ball or textured surface, tennis ball is generally utilized rather than a solid core baseball or softball. The aforementioned hollow core balls were relatively light in weight and when thrown toward a batter provided a fast moving projectile that could readily be made to alter its flight path as it approached the batter. A ball-bat for hitting such a ball should ideally be light in weight and adapted for rapid acceleration during the swinging motion. The baseball/softball bats previously described had a size and weight distribution which was necessary for providing the required impact strength for hitting a baseball or softball, but inappropriate for stickball use.

An attempt to provide a suitable stickball bat was made by using a broomstick or mop handle. A disadvantage, however, of those improvised ball-bats was that there was no consistency in size, length, diameter, or linear trueness.

Commercially available wood ball-bats designed for stickball solved some of these problems, however, those bats were manufactured with a uniform diameter and consequently did not provide a reduced diameter handle section for a comfortable hand grip or a knob for preventing the bat from slipping out of the batter's hands.

Another shortcoming of the prior wood construction stickball bats was that under actual playing conditions, they frequently splintered, cracked, became warped or were damaged when dropped on the hard playing surface or when hitting the ball at a location distant from the center of gravity.

A ball-bat design using tubular plastic construction was shown in U.S. Pat. No. 3,955,816, however, that bat was intended for use as a warm-up or practice bat and it had a weight chamber filled with sand and a relatively short length span.

The stickball bat of the instant invention in contrast, includes a tubular metal construction for strength and durability.

Furthermore, the respective components provide a weight distribution such that the center of gravity is located at a point not greater than one-half the bat length, as measured from the handle end.

SUMMARY OF THE INVENTION

Briefly, this invention relates to a stickball bat having a composite lightweight construction which includes a tubular barrel section provided with a wood handle member at one end of the barrel section and an edge protector at the other end of the barrel section. The handle member includes a collar portion at the junction between the barrel section and the handle member for providing a smooth transitional surface. The handle member further includes a knob portion at its free end for hand grip control.

The edge protector shields the margin of the barrel section from jagged edges, denting or other damage which could result from contact with a concrete playing surface.

The barrel section is comprised of a length of aluminum tubing having strength characteristics suitable for impacting with the flexible wall ball used in the game of stickball while being relatively light in weight.

The handle member is constructed of wood and has a reduced diameter in comparison to the barrel section for providing a comfortable hand grip.

A feature of this improved ball-bat construction is that the relationship between the barrel section, the handle member, and the edge protector provid.e a weight distribution for positioning the center of gravity between the midpoint of the bat and the end of the handle member. This not only permits a "quick" swing, but also aids in absorbing the shock when the bat and ball make contact.

In view of the above described construction, the ball-bat of this invention meets the criteria for a durable, lightweight ball-bat having the requisite swing characteristics for playing the game of stickball.

In view of the foregoing, it should be apparent that the present invention overcomes many of the shortcomings and eliminates many of the problems of the previously disclosed ball-bats.

Having thus summarized the invention, it will be seen that it is an object thereof to provide ball-bat construction of the general character described therein which is not subject to the aforementioned disadvantages.

Specifically, it is an object of this invention to provide a ball-bat construction for playing the game of stickball.

A further object of this invention is to provide a stickball bat having a composite construction with a weight distribution for a rapid acceleration swinging motion.

A still further object of this invention is to provide a stickball bat construction employing a lightweight metal barrel section, a wood handle member engageable within one end of the barrel section and an edge protector insertable in another end of the barrel section for preventing damage to the barrel section.

Still another object of this invention is to provide a stickball bat construction of the general character described which is simple in construction, low in cost, reliable in use, and well adapted for mass production and fabrication technique.

Other objects of the invention will in part be apparent and in part will be pointed out hereinafter.

With these ends in view, the invention finds embodiment in certain combinations of elements and arrangements of parts by which the aforementioned objects and certain other objects are hereinafter attained all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention:

FIG. 1 a perspective view of a stickball bat construction of this invention showing a barrel section, a handle member affixed at one end of the barrel section and an edge protector inserted in an oppposite end of the barrel section;

FIG. 2 an enlarged view showing the handle section including a tail section, a collar portion and a knob portion;

FIG. 3 is a sectional view to an enlarged scale taken along line 3—3 of FIG. 1 illustrating in cross-section, the barrel section with the tail section seated therein including a punch-press deformation of the barrel section for securing the tail section; and FIG. 4 is an enlarged elevational view of the edge protector showing a plug section for insertion within the barrel section, a cylindrical section for cushioning an edge of the barrel section during swingable impact and a curved tip for protecting the barrel section when the bat is struck against the ground by the batter.

DESCRIPTION OF THE PREFERRED EMBODIMENT

Referring now in detail to the drawings, the reference numeral 20 denotes generally an improved stickball bat as encompassed by this invention.

The device 20 includes a barrel section 22, a handle member 24, and an edge protector 26.

The barrel section 22 is preferably fabricated from aluminum alloy. It has been found that the alloy designated 6063T6 provides a suitable hardness and temper. The aluminum can be extruded or drawn, however, drawn aluminum tubing is preferred since the wall thickness tolerance can be more precisely controlled and further drawn tubing has been found to provide greater strength per unit length. The barrel 22 of the preferred embodiment has an outside diameter of 1.25 inches, a wall thickness of 0.05 inches, and a length dimension of between 29.5 in and 35.5 inches as will be further discussed.

For the purpose of illustration, the handle member 24 is 12.6875 inches in length and includes a tail section 28 3.25 inches in length. The handle member 24 is fabricated from wood, e.g. ash, hickory, birch, or like materials. In order to provide increased durability, the handle member 24 is coated with a polyurethane clear finish or similar substance. It has been found that a wood handle absorbs some of the shock when the ball contacts the barrel.

The diameter of the handle member 24 of this preferred embodiment is 1 inch and the diameter of the tail section is 1.155 inches. The diameter of the handle member 24 is constant in comparison to the conventional tapered bat handles.

Since the inside diameter of the barrel section 22 is 1.150 inches, there is an interference fit of 0.005 inches and as the tail section 28 is forced into the end of the barrel 22, a peripheral surface layer of the wood will be shaved and/or concomitantly the aluminum barrel 22 will be stretched. A circumferential groove 29 has been provided for accommodating the wood shavings which accumulates, and thus provides the necessary clearance as the tail section 28 is forced into the barrel section 22. By way of example, the groove 29 has a width dimension of 3/16 inch and a depth of 1/32 inch. To further secure the tail section 28 within the barrel section 22, the wall of the barrel section 22 is indented to form dimples 30 as with a punchpress. Preferably the dimples 30 are arranged in a staggered pattern as shown in FIG. 1, and will interact with the tail section 28 to provide locking engagement. Other fastener devices such as a threaded, pinned, screwed, or similar type of interconnection may also be employed.

As will be noted in FIG. 2, the tail section 28 also includes a knob portion 32. The diameter of the knob 32 of this preferred embodiment is 1.5 inches and it is provided with a 0.25 inch taper from the 1.0 inch diameter of the handle member 24. The knob portion 32 has been provided as a safety element to prevent bat 20 from slipping from the batter's hand during the swinging motion.

Another feature of the handle member 24 includes a collar portion 34. The maximum diameter of the collar portion 34 is equivalent to the outside diameter of the barrel section 22. The purpose of the collar portion 34 is to provide a smooth transitionally surface between the barrel section 22 and the handle member 24. This is of particular importance if the batter "chokes up" on the bat 20 by placing his hand on the intersection between the barrel section 22 and the handle member 24 and eliminates any uncomfortable hand contact with a sharp metal edge. A further advantage of the collar portion 34 is that it provides a limit stop when inserting the tail section 28. Considering next the opposite end of barrel section 22, there is shown in FIG. 1, the edge protector 26. The details of the edge protector 26 will be described with reference to FIG. 4. The edge protector 26 is intended for use to prevent sharp or jagged edges from forming which could create a hazardous condition to the batter and/or damage to the ball. The edge protector 26 is typically fabricated from wood or a low density polyethylene which has been found particularly suitable for this application for the reason that it does not have elastic properties which would cause the bat 20 to dangerously bounce up or rebound if it is dropped on a hard playing surface.

A plug section 36 is insertable within the open end of the barrel section 22 by a force-fit. For this purpose, the plug 36 preferably has a diameter of 1.155 inches. The plug 36 can be further secured by indenting the wall of the barrel section 22 as described with reference to the securement of the tail section 28. In addition, the plug 36 includes a groove 37 for accommodating any shaving which may accumulate and to thus provide the necessary clearance as the plug 36 is forced into the barrel section 22. The groove 37 is typically shown as being $\frac{1}{8}$ inch in width, with a depth of 1/32 inch.

A cylindrical section 38 of the edge protector 26 has a diameter equal to the diameter of the barrel section 22, i.e. 1.25 inches and a length dimension of $\frac{3}{8}$ inch. The cylindrical section 38 thus provides an extension to the barrel section 22 which shields the edge of the barrel section 22 from contact with a hard surface especially when the bat 20 is struck on the playing surface while being held or thrown by the batter.

A curved tip 40, has a radius of approximately ⅛ inch and is formed as an integral portion of the edge protector 26.

It should be noted that the respective components, namely, the barrel section 22, the handle member 24 and the edge protector 26, provide a weight distribution longitudinally balanced about a point located between the midpoint of the bat 20 and the knob portion 32. The curved tip 40 provides additional protection if the bat is impacted in a longitudinal direction with a hard surface.

Referring once again to bat length, it is within the scope of this invention to color-code various bat lengths and weights by anodizing the barrel section 22.

For example, a typical bat length of 38 inches—having a corresponding weight of between 12 to 12.5 ounces can be anodized with a blue color. A 42 inch bat having a weight within the range of 13 to 13.5 ounces, can be color-coded with a gold anodized coating. Another 44 inch bat length can, for example, have a red color coating and corresponding weight of between 14 and 14.5 ounces. This color-coding provides for ease in identification and selection of the bat.

Another aspect of the stickball bat 20 of this invention is that the barrel section 22 provides a closed air chamber and it has been found that a noticeable and audible "ping" occurs when the ball is deflected during a swinging motion in contrast to being propelled forwardly. This "ping" can thus be used as an indication for identifying a foul-tip or deflection of the ball in distinction to failure of the batter to make any contact with the ball.

It should thus be seen that there is provided a stickball bat which achieves the various objects of this invention and which is well adapted to meet conditions of practical use.

Since various possible embodiments may be made of the present invention or modifications might be made to the exemplary embodiments set forth above, it is to be understood that all materials shown and described in the accompanying drawings are to be interpreted as illustrative and not in a limiting sense.

Having thus described the invention, there is claimed as new and desired to be secured by Letters Patent:

1. A stickball bat construction including a length of tubular metal being open at oppsite ends for defining a uniform barrel section, cylindrical handle means insertable within a first of said ends of said barrel section for providing a shock absorbing hand grip distinct from the barrel section, edge protection means insertable in a second of said open ends of said barrel section for preventing edge damage to the barrel section, the respective components being adapted for providing a weight distribution for positioning the center of gravity about a point located longitudinally between approximately the midpoint of the bat and a proximal end of the handle means whereby the stickball bat may be rapidly accelerated during a swinging motion for hitting a ball.

2. A stickball bat construction as claimed in claim 1, wherein the handle means includes a tail section at a distal end, said tail section being adapted for force-fit securement within the first of said open ends of the barrel section.

3. A stickball bat construction as claimed in claim 2, wherein the handle means includes a knob portion at the proximal end, said knob portion providing improved hand grip control.

4. A stickball bat construction as claimed in claim 3, wherein the handle means further includes a collar portion, said collar portion being positionable contiguous to the first of said open ends of said barrel section for providing a transitional surface between the barrel section and the handle member.

5. A stickball bat construction as claimed in claim 1 wherein the protection means includes a plug section adapted for snug fit engagement within the second open end of said barrel section.

6. A stickball bat construction as claimed in claim 5 wherein the edge protection means further includes a cylindrical section conforming to the barrel section and extending outwardly from said second open end thereof, said edge protection means further including a curved tip for providing impact resistance.

7. A stickball bat construction as claimed in claim 2 wherein further including indentations formed within the barrel section for interlocking engagement with the tail section.

8. A stickball construction as claimed in claim 1 wherein the barrel section is made of an aluminum alloy.

9. A stickball bat construction as claimed in claim 1 wherein the barrel section is comprised of an aluminum alloy having an approximate wall thickness of 0.05 inches.

10. A stickball bat construction as claimed in claim 1 wherein the barrel section defines an enclosed air chamber, said air chamber further providing an audible signal when a ball is deflected by the barrel section during the swing motion.

11. A stickball bat construction as claimed in claim 10 wherein the barrel section is anodized in distinctive colors for coding respective bat lengths and corresponding weights.

12. A stickball bat construction as claimed in claim 2 wherein the tail section includes a clearance groove for accommodating material shavings as the tail section is force-fit into the barrel section.

13. A stickball bat construction as claimed in claim 5 wherein the plug section includes a groove for accommodating material shavings as the plug section is engaged within the barrel section.

14. A stickball bat construction as claimed in claim 6 wherein the edge protection means is fabricated with a non-elastic material.

15. A composite stickball bat constructed comprising a uniform diameter tubular metal barrel section, a non-metal handle member having a diameter less than the diameter of the barrel section, said handle including a tail section at a distal end thereof, said tail section being adapted for press-fit engagement within one end of said barrel section, said handle member including collar means positioned at a junction between the barrel section and the handle member for providing a transitional surface between the barrel section and the handle member, said handle member further including a knob portion at a proximal end thereof, edge protector means secured within an opposite end of the barrel section, said respective components providing a weight distribution longitudinally balanced about a point located between the mid-point of the bar and the knob portion whereby the bat may be rapid accelerated during a swinging motion.

* * * * *